US008197663B2

(12) United States Patent
Martyak et al.

(10) Patent No.: US 8,197,663 B2
(45) Date of Patent: Jun. 12, 2012

(54) HIGH SPEED TIN PLATING PROCESS

(75) Inventors: Nicholas M. Martyak, Doylestown, PA (US); Gary E. Stringer, Birdsboro, PA (US); Gary S. Smith, Collegeville, PA (US)

(73) Assignee: Arkema Inc., King of Prussia, PA (US)

( * ) Notice: Subject to any disclaimer, the term of this patent is extended or adjusted under 35 U.S.C. 154(b) by 997 days.

(21) Appl. No.: 12/159,244

(22) PCT Filed: Dec. 8, 2006

(86) PCT No.: PCT/US2006/047166

§ 371 (c)(1), (2), (4) Date: Jun. 26, 2008

(87) PCT Pub. No.: WO2007/078655

PCT Pub. Date: Jul. 12, 2007

(65) Prior Publication Data

US 2008/0283407 A1 Nov. 20, 2008

Related U.S. Application Data

(60) Provisional application No. 60/755,584, filed on Dec. 30, 2005.

(51) Int. Cl.
*C25D 5/50* (2006.01)
*C25D 3/32* (2006.01)

(52) U.S. Cl. ..... 205/226; 205/302; 205/303

(58) Field of Classification Search ..... 205/226, 205/303

See application file for complete search history.

(56) References Cited

U.S. PATENT DOCUMENTS

| | | | | | |
|---|---|---|---|---|---|
| 2,266,330 | A | | 12/1941 | Nachtman | |
| 2,313,371 | A | * | 3/1943 | Stack | 205/254 |
| 2,719,820 | A | | 10/1955 | Allen | |
| 4,052,234 | A | * | 10/1977 | Yamagishi et al. | 148/530 |
| 4,181,580 | A | | 1/1980 | Kitayama et al. | |
| 4,388,158 | A | | 6/1983 | Inui et al. | |
| 4,936,965 | A | | 6/1990 | Ooniwa et al. | |
| 5,039,576 | A | * | 8/1991 | Wilson | 428/626 |
| 5,176,813 | A | | 1/1993 | Newby | |
| 5,312,539 | A | | 5/1994 | Thomson | |
| 5,427,677 | A | * | 6/1995 | Mosher | 205/138 |
| 5,891,343 | A | * | 4/1999 | Hahn et al. | 210/737 |
| 6,174,426 | B1 | * | 1/2001 | Osanaiye | 205/140 |
| 6,251,255 | B1 | | 6/2001 | Copping et al. | |
| 6,280,596 | B1 | | 8/2001 | Wilkerson et al. | |
| 6,409,850 | B1 | * | 6/2002 | O'Driscoll et al. | 148/528 |
| 6,921,472 | B1 | | 7/2005 | Dulcetti et al. | |
| 2006/0191797 | A1 | * | 8/2006 | Levey et al. | 205/252 |

FOREIGN PATENT DOCUMENTS

| | | | |
|---|---|---|---|
| EP | 1 696 052 | A2 | 8/2006 |
| GB | 643928 | | 9/1950 |
| GB | 1089479 | | 11/1967 |
| JP | 2002356785 | | 2/2002 |
| JP | 2002356785 | | 12/2002 |
| JP | 2003082497 | | 3/2003 |
| WO | WO 2004101860 | A1 * | 11/2004 |

* cited by examiner

*Primary Examiner* — Harry D Wilkins, III
*Assistant Examiner* — Bryan D. Ripa
(74) *Attorney, Agent, or Firm* — Steven D. Boyd

(57) ABSTRACT

Methods for the electrolytic preparation of tin coated metals are disclosed. Organic polybasic acids, such as methanedisulfonic acid [CH2(SO3H)2], 1,3-acetonedisulfonic acid [CO(CH2SO3H)2], anhydrides, and their water soluble salts, and mixtures thereof may be used as the electrolyte in the plating process or as the flux in the reflow process. Acetone, gamma-butyrolactone, or a mixture thereof, may be applied to a tin plated surface, either before or after reflow. The methods of the invention produce plated material that is free of blue haze.

41 Claims, No Drawings

HIGH SPEED TIN PLATING PROCESS

CROSS-REFERENCE TO RELATED APPLICATIONS

This application claims priority on U.S. Provisional Application 60/755,584, filed Dec. 29, 2005, the disclosure of which is incorporated herein by reference.

FIELD OF THE INVENTION

This invention relates to the preparation of tin coated metals. In particular, this invention relates to a method for the electrolytic preparation of tin coated metals.

BACKGROUND OF THE INVENTION

Tin is resistant to corrosion and is used as a protective coating on less resistant metals, such as steel. One method of applying a tin coating is to dip a steel plate into molten tin. However, this method is wasteful because it typically produces a thicker layer of tin than is necessary. Consequently, electrolytic methods, which produce a thinner and more uniform layer of tin, have been developed. Electroplating of tin onto steel strip is disclosed, for example, in Kitayama, U.S. Pat. No. 4,181,580, the disclosure of which is incorporated herein by reference.

In the high speed tinning of strips of steel, the strips of steel are first cleaned in a series of alkaline cleaners to remove oils and greases. Then the steel passes through several water rinses and then into a dilute acid ("pickling") solution before passing into the electrolyte plating bath, which produces a layer of tin on the steel surface. The layer of tin, as deposited, typically has a smooth matte surface.

Two tin plating solutions are commonly used in strip steel tin plating baths. The FERROSTAN® system contains phenolsulfonic acid ($HOC_6H_4SO_3H$, PSA) and stannous sulfate, while the RONASTAN® system contains methanesulfonic acid ($CH_3SO_3H$, MSA) and stannous methanesulfonate. The use of MSA in electrolyte baths is disclosed, for example, In Thompson, U.S. Pat. No. 5,312,539, and in Copping, U.S. Pat. No. 6,251,255, the disclosures of which are incorporated herein by reference. The use of PSA acid electrolyte baths is disclosed, for example, in Ooniwa, U.S. Pat. No. 4,936,965, and in Dulcetti, U.S. Pat. No. 6,921,472, the disclosures of which are incorporated herein by reference.

After plating, the plated strip is typically rinsed twice with water. After rinsing, the plated strip then enters a fluxing solution (e.g., an "acid flux" solution), followed by air drying. The term "flux" refers to a substance that aids the reflow operation. The plated strip is then heated in a reflow oven to slightly above the melting point of tin (about 232° C.), typically in a reflow oven heated to about 240° C. The tin layer is melted, forming a surface layer of tin and a subsurface diffusion layer containing tin and tin-iron alloy on the steel substrate. After heating ("reflow"), the plated strip is rapidly cooled or quenched by immersion in water, producing a tin surface layer that has a bright finish.

The purpose of the rinse steps that follow plating is to remove as much of the components of the plating electrolyte solution from the tin surface as possible. Some of the plating electrolyte will be retained on the tin surface as "dragout" as it is removed from the plating bath. The dragout composition can include water, the plating acid (i.e., PSA or MSA), stannous salts, and dissolved electroplating additives. Because dragout of the components of the plating bath represents an economic loss, and because some water is lost from the plating bath due to evaporation or entrainment with gases evolved during the electroplating operation, the rinse solutions typically have a counter-current flow so that the rinse water and the plating bath components dragged into the rinse solutions with the plated strip are returned to the plating solution.

As discussed in O'Driscoll, U.S. Pat. No. 6,409,850, and in Allen, U.S. Pat. No. 2,719,820, the disclosures of which are incorporated herein by reference, the purpose of the fluxing agent is to remove oxide from the tin surface and to reduce the surface tension of the melting tin during reflow, thus preventing uneven flow of the tin during reflow. Such uneven flow can result in a non-uniform surface (e.g., "woodgrain") after quenching. Examples of fluxing agents include hydrogen chloride, stannous chloride, zinc chloride, ammonium chloride, palm oil, gluconic acid, glutamic acid, citric acid, tartaric acid, citrazinic acid, chelidamic acid, chelidonic acid, cyclohexene-1,2-dicarboximide, various naptholdisulfonic acids, and various hydroxybenzenesulfonic acids, including PSA. Although PSA serves as a good fluxing agent, MSA is not suitable as a fluxing agent due to formation of blue stains, as discussed below.

When a FERROSTAN® plating solution, which contains PSA, is used, the concentration of PSA in the acid flux solution, due to dragin from the plating bath and the prior rinse, typically is about 0.1-1.0% of PSA. An acid flux solution that contains 0.1 to 1.0% of PSA produces a bright, adherent surface layer after reflow. However, because of the presence of free phenol in a plating solution that contains PSA and because PSA has a low inherent electrical conductivity, electrolytes other than PSA have been sought.

A plating solution that contains MSA is more worker friendly because it does not contain phenol and also more conductive than a plating solution that contains PSA. In addition, MSA is a non-oxidizing acid and minimizes the oxidation of stannous ion ($Sn^{+2}$) to stannic ion ($Sn^{+4}$). Stannic ion forms stannic sludge, an insoluble oxide sludge which precipitates from solution, resulting in a loss of tin from the electroplating system. When MSA is used in the plating solution, the acid flux solution contains MSA due to dragin from the plating bath. When MSA is present in the acid flux solution, after reflow the surface layer sometimes has an undesirable blue haze, which may be deleterious to the appearance of the tin surface and may also affect the corrosion resistance of the surface layer.

Thus, a need exists for tin plating processes that do not have the disadvantages of the process that uses PSA and yet does not lead to the formation of an undesirable blue haze after reflow.

SUMMARY OF THE INVENTION

In one aspect, the invention is a method for electroplating, the method comprising the steps of:

a) electroplating tin onto a steel strip in an acidic electroplating bath comprising an electrolyte, stannous ion and an anion, and forming a plated strip comprising a plated tin surface comprising a surface layer of tin;

b) performing one or more rinses;

c) optionally exposing the plated tin surface either to (i) an aqueous solution comprising about 0.01 wt % to 10 wt % of a polybasic organic acid having one or more sulfonic acid groups and optionally one or more weaker acid functionalities, a salt thereof or anhydride thereof, or a mixture of two or more of the polybasic organic acid, the anhydride thereof, and the salts thereof, or (ii) a solution of about 0.01 vol % to 10 vol % of an organic compound in water, the organic compound selected from the group consisting of acetone, gamma-butyrolactone, and mixtures thereof;

d) heating the plated strip to at least the melting point of tin but to less than the melting point of the steel strip; and e) either (i) quenching the plated strip in water or (ii) quenching the plated steel strip in a solution of about 0.01 vol % to 10 vol % of an organic compound in water;

in which, if the electrolyte is not a polybasic organic acid having one or more sulfonic acid groups and optionally one or more weaker acid functionalities, a salt thereof or anhydride thereof, or a mixture of two or more of the polybasic organic acid, the anhydride thereof, and the salts thereof, the method comprises either step c) or step e)(ii).

In another aspect, the invention relates to the components of the plating baths, rinses and/or solution employed in the tin electroplating operations. The components of the aqueous baths, rinses and/or solutions of the invention comprise polybasic organic acids having one or more sulfonic acid groups and optionally one or more weaker acid functionalities, salts or anhydrides thereof, and mixtures thereof, and/or mixtures of organic compounds in water, such as acetone, gamma-butyrolactone, and mixtures thereof. For example, the invention relates to aqueous plating solutions that comprise a polysulfonic acid, for example, to aqueous plating solutions that comprise stannous ion, and about 0.01 wt % to 10 wt % of (1) an alkyl polysulfonic acid, such as methanedisulfonic acid, 1,3-acetonedisulfonic acid, or a mixture thereof, (2) an anhydride thereof, (3) a salt thereof, or (4) a mixture thereof.

In another aspect, the invention relates to the tin-plated steel thus produced by the uses of the methods described above.

DETAILED DESCRIPTION OF THE INVENTION

Unless the context indicates otherwise, in the specification and claims the terms polysulfonic acid, disulfonic acid, alkyl polysulfonic acid, alkyl disulfonic acid, anhydride, salt, organic compound, and similar terms also include mixtures of such materials. Unless otherwise specified, all percentages are percentages by weight and all temperatures are in degrees Centigrade (degrees Celsius).

A conventional tin plating facility uses the following steps in the following order:

plating->first water rinse->second water rinse->acid flux (with same acid used in plating or an added fluxing agent)->air dry->reflow->quench in water->dry The terms "flux" and "fluxing agent" generally refer to materials that aid in the fusing and/or flowing of the tin layer. Tin plating processes in which MSA is present in the acid flux can, after reflow, produce a surface layer that has a blue haze. The presence of this blue haze may affect the corrosion resistance of the surface layer. We have found that blue haze on the surface layer after reflow can be eliminated by the methods described below.

Use of an Alkyl Di- or Polysulfonic Acid

Blue haze after reflow can be eliminated by the use of an alkyl polysulfonic acid or a salt thereof, such as a disulfonic acid, preferably an alkyl disulfonic acid, an anhydride thereof, and/or a salt thereof. An aqueous solution of an alkyl polysulfonic acid and/or an alkyl polysulfonic acid salt can be used as rinse or flux immediately preceding reflow. The solution typically comprises about 0.01 wt % to about 10 wt % of acid and/or acid salt. Preferably, at least enough of the acid is present so that the rinse solution is acidic (pH<6.95). An inorganic acid, such as sulfuric acid, may be present to produce an acidic solution.

The alkyl polysulfonic acid may be mixed with other sulfonic acids, for example, methane sulfonic acid, phenol sulfonic acid, and isethionic (2-hydroxyethanesulfonic acid), and/or inorganic acids, such as sulfuric acid, and/or their salts, such as their ammonium, sodium, and/or potassium salts. Any of these mixtures of polysulfonic acid and/or polysulfonic acid salt, with or without added acid and/or added acid salt, may also be used as acid/current carrier in the tin plating solution.

Suitable organic polysulfonic acids include linear, branched, alkyl, and aromatic polybasic acids, excluding those that contain hydroxyaryl functionality. Suitable organic polysulfonic acid include, for example, methanedisulfonic acid [$CH_2(SO_3H)_2$] and 1,3-acetonedisulfonic acid [$CO(CH_2SO_3H)_2$], $C_2$-$C_{20}$ alkanedisulfonic or polysulfonic acids, such as acids of the formula $HO_3SO(CH_2)_nSO_3H$, in which n is 2 to 20, for example $HO_3SO(CH_2)_2SO_3H$, $HO_3SO(CH_2)_3SO_3H$, and $HO_3SO(CH_2)_4SO_3H$, anhydrides of these acids, and salts of these acids.

Dibasic and polybasic acids with one or more sulfonic acid groups in addition to one or more carboxylic or phosphonic acid groups, such as sulfobenzoic acid [o-, m-, and p-$HO_3SC_6H_4CO_2H$], sulfoacetic acid, [$HO_3SOCH_2CO_2H$], sulfosuccinic [$HO_2CCH(SO_3H)CH_2CO_2H$], 2-sulfopropanoic acid [$CH_3CH[(SO_3H)CO_2H$]; and 3-sulfopropanoic acid [$HO_3SO(CH_2)_2CO_2H$], and their anhydrides and their salts are also useful. Typical salts are water soluble salts, such as the alkali metal salts, especially the sodium and potassium salts, and ammonium and substituted ammonium salts.

Although no visible stain is observed following reflow on tin deposits prepared using sulfuric acid free from MSA and other acids in the plating bath, these deposits are difficult to reflow and, consequently, commercially unacceptable. The measured conductivity of solution of sulfuric acid is less than a solution of a sulfonic acid, such as MSA, at the same normality and temperature. For example, the conductivity of a 0.4 N sulfuric acid solution at 40° C. is 107.3 mS/cm while the conductivity of a 0.4 N MSA solution at the same normality and temperature is 166.5 mS/cm. However, the conductivity of the alkyl disulfonic acid MDSA is equivalent to that of MSA at the same normality and temperature. For example, the conductivity of a 0.4 N MDSA solution at 40° C. is 170.4 mS/cm. Thus, although sulfuric acid can not replace MSA in plating baths, alkyl polysulfonic acids, including alkyl disulfonic acids such as MDSA, and be used in place of MSA in plating baths.

Mixtures of MSA and alkyl polysulfonic acids may also be used, provided the normality of the alkyl polysulfonic acid is at least about equal to that of the MSA. For example, when a 0.4 N acid that 3/1 MSA:MDSA was used in the plating bath, a visible blue stain was observed. However, when a 0.4 N acid that 1/1 or 1/3 MSA:MDSA was used in the plating bath, no visible blue stain was observed.

Further, mixtures of alkyl polysulfonic acids and sulfuric acid may be used, provided the ratio of the normality of the alkyl polysulfonic acid is at least about one third that of the sulfuric acid. For example, when a 0.4 N total acid solution in which the ratio of sulfuric acid to MDSA was 3/1 used in the plating bath, no visible blue stain was observed and the tin deposit was not difficult to reflow.

Use of a Water/Organic Compound Mixture

Though not being bound by any theory of explanation, it is believed that the blue haze that forms when MSA is used as the electrolyte, may be, at least in part, organic in nature. When the TP-SR Additive, the additive used with MSA electrolyte in the RONASTAN® system, was omitted from the plating bath, no blue haze was formed on conventional washing and reflow. When the TP-SR Additive was replaced with ENSA additive (ethoxylate of α-naphthol sulfonic acid), the additive used in the FERROSTAN® process, during plating using MSA electrolyte, no blue haze was formed, but following reflow the plated tin surface was not as bright as that formed using TP-SR Additive.

Formation of blue haze is eliminated by use of a mixture of water and an organic compound. The water/organic compound mixture may be used either in place of the fluxing solution and/or in the quench. The solution typically contains about 0.01% to 10% of the organic compound. The minimum amount necessary to prevent blue haze formation is typically used. Alternatively, the water/organic compound mixture, or the organic compound, can be sprayed or wiped onto the tin plated surface either before or after reflow. The plated substrate can also be dipped in the organic compound, either before or after reflow.

Organic compounds that are miscible with water or that have sufficient solubility in water to form at least an about 1% (volume:volume) solution in water may be used. The water/organic compound mixture should be a single phase. Preferred organic compounds include acetone, gamma-butyrolactone, and mixtures thereof. Other useful materials are compounds with β-dicarbonyl groups, such as acetylacetone and acetoacetic esters, and compounds with two nitrile groups on the same carbon atom, such as malononitrile. The following organic compounds were found to be not effective in preventing blue haze: dimethyl sulfoxide, dimethyl formamide, acetonitrile, sulfolane, methanol, ethanol, ethylene glycol, tetrahydrofuran, ethyl acetate, toluene, and hexanes.

Industrial Applicability

The methods of the invention can be used for the preparation of tin coated metals, especially tin coated steel, known as "tinplate." The tin layer on each surface is typically about 0.38 micron to about 1.6 micron thick. The tin coated steel strip is typically about 0.15 mm to about 0.60 mm thick. Cans made of tin plated steel ("tin cans") are widely used in packaging, such as in the packaging of food and beverages, as well as in the packaging of other materials, such as paint and motor oil.

The advantageous properties of this invention can be observed by reference to the following examples, which illustrate but do not limit the invention.

EXAMPLES

Glossary

| | |
|---|---|
| MSA | Methanesulfonic acid ($CH_3SO_3H$) |
| ENSA Additive | Ethoxylate of α-naphthol sulfonic acid; electroplating additive (Rohm & Haas, Philadelphia, PA) |
| PSA | Phenolsulfonic acid ($HOC_6H_4SO_3H$) |
| $Sn(CH_3SO_3)_2$ | Tin(II) methanesulfonate |
| TP-SR Additive | RONASTAN ® TP-SR tin plating additive (Rohm & Haas, Philadelphia, PA) |

Comparative Example 1

This Example shows that blue haze is not formed when a FERROSTAN® system, containing PSA and stannous sulfate, is used.

Tin was plated onto freshly cleaned steel strips using the following plating solution:

| | |
|---|---|
| Stannous sulfate | 36 g/l (20 g/l as Sn) |
| PSA | 60 g/l (92 g/l of 65% commercial material) |
| ENSA | 3 g/l |

Steel panels about 2 cm×10 cm were cleaned and plated in the plating bath using a current of 1.25 amperes for 25 sec. The temperature of the plating bath was 43° C. The thickness of the resulting tin deposit was about 1 micron.

The resulting plated panel was rinsed in (1) a solution containing 65% of the tin plating electrolyte; (2) a solution containing 35% of the tin plating electrolyte; and a solution containing 15% of the tin plating electrolyte, and air dried. The plated panel was heated at about 250° C. using a hot air gun for a time sufficient to melt the tin (reflow) and then immediately quenched in water and dried. No blue haze was observed on the tin layer.

Comparative Example 2

This Example shows that blue haze is formed when a RONASTAN® system, containing methanesulfonic acid ($CH_3SO_3H$, MSA) and stannous methanesulfonate, is used.

The procedure of Comparative Example 1 was repeated, except that the following plating solution was used.

| | |
|---|---|
| $Sn(CH_3SO_3)_2$ | 66.7 ml/l of 300 g/l tin concentrate (20 g/l as Sn) |
| MSA | 40 g/l |
| TP-SR Additive | 50 ml/l |
| Hydroquinone | 1 g/l |

The temperature of the plating bath was 40° C. The resulting plated steel panel was rinsed in the same sequence of rinses as in Comparative Example 1. The plated panel was heated at about 250° C. using a hot air gun for a time sufficient to melt the tin (reflow) and then immediately quenched in water and dried. A blue haze was observed on the surface of the tin layer.

Example 1

The procedure of Comparative Example 2 was repeated except that the third rinse was a rinse in 5% methanedisulfonic acid [$CH_2(SO_3H)_2$]. A blue haze was observed on the tin layer after reflow. The water quench after reflow removed the blue haze.

Example 2

The procedure of Comparative Example 2 was repeated except that a fourth rinse in 5% 1,3-acetonedisulfonic acid, dipotassium salt [$CO(CH_2SO_3K)_2$] was added to the procedure. A blue haze was observed on the tin layer after reflow. After the water quench, only a slight blue haze was observed on the tin layer.

Example 2b

The procedure of Example 2a was repeated except that the fourth rinse contained 5% 1,3-acetonedisulfonic acid, dipotassium salt [$CO(CH_2SO_3K)_2$] and one molar equivalent of sulfuric acid. A blue haze was observed on the tin layer after reflow, but the water quench removed the blue haze.

Example 3

The procedure of Comparative Example 2 was repeated, except that the hydroquinone and the TP-SR Additive were omitted from the plating bath. No blue haze was observed on the tin layer after the water quench.

Example 4a

The procedure of Comparative Example 2 was repeated, except that only the TP-SR Additive was omitted from the plating bath. No blue haze was observed on the tin layer after the water quench.

Example 4b

The procedure of Comparative Example 2 was repeated, except that only the hydroquinone was omitted from the plating bath. A blue haze was observed on the tin layer after the water quench.

Example 5

The procedure of Comparative Example 2 was repeated, except that the TP-SR Additive in the plating bath was replaced with ENSA Additive, the additive used in the FERROSTAN®/PSA system. No blue haze was observed on the tin layer after the water quench. However, the tin surface was not as bright as it was when the TP-SR Additive is used in the plating bath. The results of Examples 3, 4a, 4b and 5 suggest that the formation of the blue haze is associated with the presence of the TP-SR Additive in the plating bath.

Example 6a

The procedure of Comparative Example 1 was repeated except that the following plating solution was used.

| | |
|---|---|
| $Sn(CH_3SO_3)_2$ | 66.7 ml/l of 300 g/l tin concentrate (20 g/l as Sn) |
| Methanedisulfonic acid | 5 g/l |
| TP-SR Additive | 50 ml/l |
| Hydroquinone | 1 g/l |
| The temperature of the plating bath was 40° C. | |

The resulting plated panel was rinsed in (1) a solution containing 65% of the tin plating electrolyte; (2) a solution containing 35% of the tin plating electrolyte; and (3) a solution containing 15% of the tin plating electrolyte, and air dried. The plated panel was heated at about 250° C. using a hot air gun for a time sufficient to melt the tin (reflow) and then immediately quenched in water and dried. A blue haze was observed on the tin layer after reflow, but the water quench after reflow removed the blue haze.

Example 6b

The procedure of Comparative Example 1 was repeated except that the following plating solution was used.

| | |
|---|---|
| $Sn(CH_3SO_3)_2$ | 66.7 ml/l of 300 g/l tin concentrate (20 g/l as Sn) |
| 1,3-acetonedisulfonic acid, potassium salt | 40 g/l |

-continued

| | |
|---|---|
| Sulfuric acid | 5 g/l |
| TP-SR Additive | 50 ml/l |
| Hydroquinone | 1 g/l |

The temperature of the plating bath was 40° C.

The resulting plated panel was rinsed in (1) a solution containing 65% of the tin plating electrolyte; (2) a solution containing 35% of the tin plating electrolyte; and (3) a solution containing 15% of the tin plating electrolyte, and air dried. The plated panel was heated at about 250° C. using a hot air gun for a time sufficient to melt the tin (reflow) and then immediately quenched in water and dried. A blue haze was observed on the tin layer after reflow, but the water quench after reflow removed the blue haze.

Examples 7a and 7b

The procedures of Example 6a and 6b were both repeated, except that the plated panel was only rinsed once, using a rinse containing 25% of the original plating solution. In each both case, a blue haze was observed on the tin layer after reflow, but the water quench after reflow removed the blue haze.

Example 8

The procedure of Comparative Example 2 was followed except that a fourth rinse in 5% aqueous acetone was added to the procedure. No blue haze was observed on the tin layer after the water quench.

Similar results were observed when gamma-butyrolactone was used in place of acetone. The following organic compounds were evaluated as replacements for the acetone but were found to be not effective in preventing blue haze in this procedure: dimethyl sulfoxide, dimethyl formamide, acetonitrile, sulfolane, methanol, ethanol, ethylene glycol, tetrahydrofuran, ethyl acetate, toluene, and hexanes. The compounds that did not have sufficient solubility in water to form a 5% solution were used as dispersions in water.

Example 9

The procedure of Comparative Example 2 was followed except that the plated panel was quenched in 5% aqueous acetone following reflow. No blue haze was observed on the tin layer after the quench. A cloudy suspension was observed in the quench solution. Treatment following reflow with acetone in the absence of water also removed the blue haze.

Example 10

This Example illustrates the conductivity of the acids used in the tin plating solutions. The dibasic acids sulfuric acid and MDSA were evaluated along with the monobasic acid MSA. The target conductivity tin plating solutions is about 160 mS/cm. A conductivity that is too low requires too much power for plating. A conductivity that is too high cause extraneous tin-plating on the conductor roller in the tin mill.

A 0.4 N solution of MSA was prepared by diluting 27.5 g of 70% MSA solution to 500 ml with deionized water. The results are given in Table 1.

TABLE 1

| CONDUCTIVITY OF MSA SOLUTIONS | | | | |
|---|---|---|---|---|
| | Conductivity (mS/cm) | | | |
| Temperature | 0.1 N MSA | 0.2 N MSA | 0.3 N MSA | 0.4 N MSA |
| 20° C. | 38.5 | 70.0 | 102.9 | 129.1 |
| 25° C. | 40.1 | 74.2 | 110.1 | 138.4 |
| 30° C. | 41.5 | 79.0 | 118.0 | 147.0 |
| 35° C. | 43.8 | 84.1 | 125.2 | 157.6 |
| 40° C. | 46.4 | 89.0 | 132.7 | 166.5 |
| 45° C. | 47.9 | 93.8 | 140.4 | 175.0 |
| 50° C. | 49.6 | 99.1 | 148.2 | 185.1 |

The target conductivity of about 160 mS/cm was observed at 0.4 N MSA and between 35° C. and 40° C.

A 0.4 N solution of MDSA was prepared by diluting 36 g of 50% MDSA solution to 500 ml with deionized water. The results are given in Table 2.

TABLE 2

| CONDUCTIVITY OF MDSA SOLUTIONS | | | | |
|---|---|---|---|---|
| | Conductivity (mS/cm) | | | |
| Temperature | 0.1 N MDSA | 0.2 N MDSA | 0.3 N MDSA | 0.4 N MDSA |
| 20° C. | 34.4 | 70.2 | 105.3 | 131.6 |
| 25° C. | 37.0 | 75.7 | 112.3 | 142.4 |
| 30° C. | 39.3 | 81.0 | 119.9 | 152.1 |
| 35° C. | 41.8 | 86.0 | 127.4 | 161.5 |
| 40° C. | 44.3 | 91.0 | 134.8 | 170.4 |
| 45° C. | 46.6 | 96.2 | 141.9 | 179.8 |
| 50° C. | 48.8 | 101.8 | 149.0 | 188.2 |

The target conductivity of about 160 mS/cm was observed at 0.4 N MDSA and between 35° C. and 40° C.

A 0.4 N solution of sulfuric acid was prepared by diluting 5.5 ml of concentrated sulfuric acid to 500 ml with deionized water. The results are given in Table 3.

TABLE 3

| CONDUCTIVITY OF SULFURIC ACID SOLUTIONS | | | | |
|---|---|---|---|---|
| | Conductivity (mS/cm) | | | |
| Temperature | 0.1 N $H_2SO_4$ | 0.2 N $H_2SO_4$ | 0.3 N $H_2SO_4$ | 0.4 N $H_2SO_4$ |
| 20° C. | 26.2 | 42.9 | 70.0 | 96.7 |
| 25° C. | 27.1 | 45.6 | 73.2 | 99.1 |
| 30° C. | 28.1 | 47.8 | 76.2 | 100.3 |
| 35° C. | 29.0 | 49.8 | 79.1 | 103.7 |
| 40° C. | 30.0 | 51.6 | 81.9 | 107.3 |
| 45° C. | 31.0 | 53.3 | 85.1 | 111.1 |
| 50° C. | 32.2 | 55.4 | 88.0 | 114.6 |

The target conductivity of about 160 mS/cm was not observed, even with 0.4 N sulfuric acid and at 50° C.

The ratios of the conductivities of the three acids at the same temperature and concentration were calculated at each temperature and concentration investigated to determine the extent of de-protonation of each acid.

The conductivity ratio for MSA/MDSA is shown in Table 4.

TABLE 4

| CONDUCTIVITY RATIO of MSA/MDSA | | | | | |
|---|---|---|---|---|---|
| | Conductivity Ratio (MSA/MDSA) | | | | |
| TEMPERATURE | 0.1 N | 0.2 N | 0.3 N | 0.4 N | Total |
| 20° C. | 1.12 | 1.00 | 0.98 | 0.98 | 4.07 |
| 25° C. | 1.08 | 0.98 | 0.98 | 0.97 | 4.02 |
| 30° C. | 1.06 | 0.98 | 0.98 | 0.97 | 3.98 |
| 35° C. | 1.05 | 0.98 | 0.98 | 0.98 | 3.98 |
| 40° C. | 1.05 | 0.98 | 0.98 | 0.98 | 3.99 |
| 45° C. | 1.03 | 0.98 | 0.99 | 0.97 | 3.97 |
| 50° C. | 1.02 | 0.97 | 0.99 | 0.98 | 3.97 |

The average of the measured ratios is 1.00. Because the MSA and MDSA have about the same conductivity at the same normality and temperature, both protons of MDSA are free, i.e., the second proton of MDSA is essentially completely ionized at these concentrations and temperatures.

The conductivity ratio for MSA/$H_2SO_4$ is shown in Table 5.

TABLE 5

| CONDUCTIVITY RATIO of MSA/$H_2SO_4$ | | | | | |
|---|---|---|---|---|---|
| | Conductivity Ratio (MSA/$H_2SO_4$) | | | | |
| Temperature | 0.1 N | 0.2 N | 0.3 N | 0.4 N | Total |
| 20° C. | 1.47 | 1.63 | 1.47 | 1.34 | 5.91 |
| 25° C. | 1.48 | 1.63 | 1.50 | 1.40 | 6.01 |
| 30° C. | 1.48 | 1.65 | 1.55 | 1.47 | 6.14 |
| 35° C. | 1.51 | 1.69 | 1.58 | 1.52 | 6.30 |
| 40° C. | 1.55 | 1.72 | 1.62 | 1.55 | 6.44 |
| 45° C. | 1.55 | 1.76 | 1.65 | 1.58 | 6.53 |
| 50° C. | 1.54 | 1.79 | 1.68 | 1.62 | 6.63 |

The average of the measured ratios is 1.52. This indicates that the second proton of the sulfuric acid is only 50% de-protonated at these concentrations and temperatures. Therefore, MSA is much more conductive than sulfuric acid the concentrations and temperatures investigated.

The conductivity ratio for MDSA/$H_2SO_4$ is shown in Table 6.

TABLE 6

| CONDUCTIVITY RATIO of MDSA/$H_2SO_4$ | | | | | |
|---|---|---|---|---|---|
| | Conductivity Ratio (MDSA/$H_2SO_4$) | | | | |
| Temperature | 0.1 N | 0.2 N | 0.3 N | 0.4 N | Total |
| 20° C. | 1.31 | 1.64 | 1.50 | 1.36 | 5.81 |
| 25° C. | 1.37 | 1.66 | 1.53 | 1.44 | 6.00 |
| 30° C. | 1.40 | 1.69 | 1.57 | 1.52 | 6.18 |
| 35° C. | 1.44 | 1.73 | 1.61 | 1.56 | 6.34 |
| 40° C. | 1.48 | 1.76 | 1.65 | 1.59 | 6.47 |
| 45° C. | 1.50 | 1.80 | 1.67 | 1.62 | 6.59 |
| 50° C. | 1.52 | 1.84 | 1.69 | 1.64 | 6.69 |

The average of the measured ratios is 1.52. This indicates that the second proton of the sulfuric acid is only 50% de-protonated at these concentrations and temperatures. Therefore, MDSA is much more conductive than sulfuric acid the concentrations and temperatures investigated.

Example 11

This Example compares the conductivity of tin solutions containing MSA and/or containing MDSA at a constant normality.

Solutions containing $Sn(CH_3SO_3)_2$ [20 g/l as free $Sn^{+2}$], 0.4 N of acid as indicated in Table 7, 50 ml/l of TP-SR Additive, and 1 g/l of hydroquinone. The solutions were heated and the conductivity measured. The results are shown in Table 7.

TABLE 7

CONDUCTIVITY AS A FUNCTION OF ACID

| | Acid Concentration | | | | |
|---|---|---|---|---|---|
| Temp. (° C.) | 0.4 N MSA | 0.3 N MSA 0.1 N MDSA | 0.2 N MSA 0.2 N MDSA | 0.1 N MSA 0.3 N MDSA | 0.4 N MDSA |
| 20 | 140.0 | 139.0 | 140.6 | 141.2 | 140.4 |
| 25 | 149.9 | 148.1 | 150.4 | 149.9 | 149.5 |
| 30 | 160.7 | 158.9 | 161.4 | 161.3 | 160.7 |
| 35 | 171.7 | 169.5 | 171.9 | 170.9 | 171.4 |
| 40 | 182.4 | 181.0 | 182.4 | 181.6 | 181.4 |
| 45 | 192.1 | 191.4 | 193.0 | 192.4 | 192.4 |
| 50 | 201.0 | 201.0 | 202.0 | 201.0 | 202.0 |

At the same temperature, the conductivity of all the tin solutions is about the same, regardless of the acid, or mixture of acids, used.

Example 12

This Example compares plating of tin using tin solutions containing MSA and/or containing MDSA at a constant normality.

The five solutions whose conductivity was measured in Example 11 evaluated for tin plating. Pieces of low carbon steel were cleaned, degreased in an alkaline medium, rinsed in water, immersed in 5% hydrochloric acid for five seconds, and rinsed in water a second time. Each of the solutions from Example 11 was heated to 40° C. and a piece of the cleaned low carbon steel plated at 10 A/dm$^2$ for 25 seconds.

Each of the tin-plated steel samples was rinsed in a 65% plating solution/35% deionized water rinse, rinsed in a 35% plating solution/65% deionized water rinse, and rinsed in 15% plating solution/85% deionized water rinse. The tin-plated steel samples were then dried with a paper towel. After the samples were dry, the tin was reflowed by passing hot air over the tin-plated steel surface for a time sufficient to melt the tin (~5 seconds). After the tin melted, each tin-plated steel sample was immediately quenched in running water then dried.

The samples were visually inspected for a blue haze or stain. The results are shown below.

| ACID | OBSERVATION |
|---|---|
| 0.4 N MSA | Visible Blue Stain |
| 0.3 N MSA/0.1 N MDSA | Visible Blue Stain |
| 0.2 N MSA/0.2 N MDSA | No Visible Blue Stain |
| 0.1 N MSA/0.3 N MDSA | No Visible Blue Stain |
| 0.4 N MDSA | No Visible Blue Stain |

As long as the normality of MDSA is at least equal to the normality of MSA at 40° C. and 0.4 N total acid normality, there is no blue stain.

Example 13

This Example compares the conductivity of tin solutions containing MDSA and/or containing sulfuric acid (free of MSA) at a constant normality.

Solutions as described in Table 8 were prepared using stannous sulfate, $SnSO_4$ [12 g/l as free $Sn^{+2}$], 0.4 N sulfuric acid and/or 0.4 N MDSA, 50 ml/l TP-SR grain refining additive (obtained from Rohm and Haas) and 1 g/l hydroquinone. The solutions were heated and the conductivity measured:

TABLE 8

CONDUCTIVITY AS A FUNCTION OF ACID

| | Acid Concentration | | | | |
|---|---|---|---|---|---|
| Temp (° C.) | 0.4 N $H_2SO_4$ | 0.3 N $H_2SO_4$ 0.1 N MDSA | 0.2 N $H_2SO_4$ 0.2 N MDSA | 0.1 N $H_2SO_4$ 0.3 N MDSA | 0.4 N MDSA |
| 20 | 87.6 | 93 | 98.7 | 115.6 | 121.2 |
| 25 | 91 | 98.6 | 103.5 | 122.1 | 128.5 |
| 30 | 95.5 | 103.5 | 109.1 | 129.8 | 136.8 |
| 35 | 99.6 | 109.1 | 114.2 | 136.4 | 144.7 |
| 40 | 103.4 | 114.2 | 119.4 | 144.5 | 152.3 |
| 45 | 107.6 | 119.7 | 124.7 | 151 | 159.6 |
| 50 | 111.5 | 124.9 | 130 | 158.4 | 167 |
| 55 | 115.8 | 130.2 | 135.3 | 165.8 | 174.4 |

The conductivity is much less in 0.4 N sulfuric acid electrolyte than in 0.4 N MDSA. Increasing the relative amount of MDSA at 0.4 N total acid normality increases the conductivity of the solution.

Example 14

This Example compares plating of tin using tin solutions containing MDSA and/or containing sulfuric acid at a constant normality.

The five solutions whose conductivity was measured in Example 13 evaluated for tin plating. Pieces of low carbon steel were cleaned, degreased in an alkaline medium, rinsed in water, immersed in 5% hydrochloric acid for five seconds, and rinsed in water a second time. Each of the solutions from Example 13 was heated to 40° C. and a piece of the cleaned low carbon steel plated at 10 A/dm$^2$ for 25 seconds.

Each of the tin-plated steel samples was rinsed in a 65% plating solution/35% deionized water rinse, rinsed in a 35% plating solution/65% deionized water rinse, and rinsed in 15% plating solution/85% deionized water rinse. The tin-plated steel samples were then dried with a paper towel. After the samples were dry, the tin was reflowed by passing hot air over the tin-plated steel surface for a time sufficient to melt the tin (~5 seconds). After the tin melted, each tin-plated steel sample was immediately quenched in running water then dried.

The samples were visually inspected for a blue haze or stain. The results are shown below.

| ACID | OBSERVATION |
|---|---|
| 0.4 N $H_2SO_4$ | Difficult to Reflow; No Visible Blue Stain |
| 0.3 N $H_2SO_4$/0.1 N MDSA | No Visible Blue Stain |
| 0.2 N $H_2SO_4$/0.2 N MDSA | No Visible Blue Stain |
| 0.1 N $H_2SO_4$/0.3 N MDSA | No Visible Blue Stain |
| 0.4 N MDSA | No Visible Blue Stain |

The tin deposit from the 0.4 N sulfuric acid plating solution showed no blue stain, but was difficult to reflow. No blue stain was observed on any of the other samples.

This shows that formulating a tin solution using a di-protic acid to achieve the correct electrolyte conductivity and proper tin-deposit characteristics is not easy. Using only sulfuric acid only in the plating solution will not produce the desired conductivity, and the deposit is commercially unacceptable. When MDSA, either by itself or in combination with sulfuric acid, is used in the plating solution, the proper solution conductivity and a good tin deposit are observed. It is thus possible use other tin salts in conjunction with MDSA to formulate an acid tin plating solution.

Having described the invention, we now claim the following and their equivalents.

The invention claimed is:

1. A method for plating tin, the method comprising the steps of:

a) electroplating tin onto a steel strip in an acidic electroplating bath comprising an electrolyte, stannous ion and an anion, and forming a plated strip comprising a plated tin surface comprising a surface layer of tin;

b) performing one or more rinses;

c) optionally exposing the plated tin surface either to (i) an aqueous solution comprising about 0.01 wt % to 10 wt % of a polybasic organic acid having one or more sulfonic acid groups and optionally one or more weaker acid functionalities, a salt thereof or anhydride thereof, or a mixture of two or more of the polybasic organic acid, the anhydride thereof, and the salts thereof, or (ii) a solution of about 0.01 vol % to 10 vol % of an organic compound in water, the organic compound selected from the group consisting of acetone, gamma-butyrolactone, and mixtures thereof;

d) heating the plated strip to at least the melting point of tin but to less than the melting point of the steel strip; and e) either (i) quenching the plated strip in water or (ii) quenching the plated steel strip in a solution of about 0.01 vol % to 10 vol % of an organic compound in water, the organic compound selected from the group consisting of acetone, gamma-butyrolactone, and mixtures thereof;

in which, if the electrolyte is not a polybasic organic acid having one or more sulfonic acid groups and optionally one or more weaker acid functionalities, a salt thereof or anhydride thereof, or a mixture of two or more of the polybasic organic acid, the anhydride thereof, and the salts thereof, the method comprises either step c) or step e)(ii) and further wherein said method comprises either step c)(ii) or step e)(ii), but not both step c)(ii) and step e)(ii).

2. The method of claim 1 in which the method comprises step c)(i).

3. The method of claim 2 in which the polybasic organic acid having one or more sulfonic acid groups is an alkyl polysulfonic acid.

4. The method of claim 3 in which the alkyl polysulfonic acid is an alkyl disulfonic acid.

5. The method of claim 4 in which the alkyl disulfonic acid is selected from the group consisting of methanedisulfonic acid, 1,3-acetonedisulfonic acid, anhydrides thereof, salts thereof, and mixtures thereof.

6. The method of claim 1 in which the acidic electroplating solution comprises an alkyl polysulfonic acid and sulfuric acid, in which the ratio of sulfuric acid to alkyl polysulfonic acid, based on the normality of the acids, is about 3/1 or less.

7. The method of claim 6 in which the alkyl polysulfonic acid is an alkyl disulfonic acid.

8. The method of claim 7 in which the alkyl disulfonic acid is methane disulfonic acid.

9. The method of claim 1 in which the acidic electroplating solution comprises an alkyl polysulfonic acid and methane sulfonic acid, in which the ratio of methane sulfonic acid to alkyl polysulfonic acid, based on the normality of the acids, is about 1/1 or less.

10. The method of claim 9 in which the alkyl polysulfonic acid is an alkyl disulfonic acid.

11. The method of claim 10 in which the alkyl disulfonic acid is methane disulfonic acid.

12. The method of claim 10 the anion is methane sulfonate anion.

13. The method of claim 1 in which the anion is methane sulfonate anion.

14. The method of claim 1 in which the anion is an alkyl polysulfonic acid anion.

15. The method of claim 1 in which the polybasic organic acid having one or more sulfonic acid groups is an alkyl polysulfonic acid.

16. The method of claim 15 in which the alkyl polysulfonic acid is an alkyl disulfonic acid.

17. The method of claim 16 in which the alkyl disulfonic acid is selected from the group consisting of methanedisulfonic acid, 1,3-acetonedisulfonic acid, anhydrides thereof, salts thereof, and mixtures thereof.

18. A method for plating tin, the method comprising the steps of:

a) electroplating tin onto a steel strip in an acidic electroplating bath comprising an electrolyte, stannous ion and an anion, and forming a plated strip comprising a plated tin surface comprising a surface layer of tin;

b) performing one or more rinses;

c) exposing the plated tin surface to an aqueous solution comprising about 0.01 wt % to 10 wt % of a polybasic organic acid having one or more sulfonic acid groups and optionally one or more weaker acid functionalities, a salt thereof or anhydride thereof, or a mixture of two or more of the polybasic organic acid, the anhydride thereof, and the salts thereof;

d) heating the plated strip to at least the melting point of tin but to less than the melting point of the steel strip; and e) quenching the plated steel strip in a solution of about 0.01 vol % to 10 vol % of an organic compound in water, the organic compound selected from the group consisting of acetone, gamma-butyrolactone, and mixtures thereof.

19. The method of claim 18 in which the polybasic organic acid having one or more sulfonic acid groups is an alkyl polysulfonic acid.

20. The method of claim 19 in which the alkyl polysulfonic acid is an alkyl disulfonic acid.

21. The method of claim 20 in which the alkyl disulfonic acid is selected from the group consisting of methanedisulfonic acid, 1,3-acetonedisulfonic acid, anhydrides thereof, salts thereof, and mixtures thereof.

22. The method of claim 18 in which the acidic electroplating solution comprises an alkyl polysulfonic acid and sulfuric acid, in which the ratio of sulfuric acid to alkyl polysulfonic acid, based on the normality of the acids, is about 3/1 or less.

23. The method of claim 22 in which the alkyl polysulfonic acid is an alkyl disulfonic acid.

24. The method of claim 23 in which the alkyl disulfonic acid is methane disulfonic acid.

25. The method of claim 18 in which the acidic electroplating solution comprises an alkyl polysulfonic acid and methane sulfonic acid, in which the ratio of methane sulfonic acid to alkyl polysulfonic acid, based on the normality of the acids, is about 1/1 or less.

26. The method of claim 25 in which the alkyl polysulfonic acid is an alkyl disulfonic acid.

27. The method of claim 26 in which the alkyl disulfonic acid is methane disulfonic acid.

28. The method of claim 18 in which the anion is methane sulfonate anion.

29. The method of claim 18 in which the anion is an alkyl polysulfonic acid anion.

30. The method of claim 18 in which the polybasic organic acid having one or more sulfonic acid groups is an alkyl polysulfonic acid.

31. The method of claim 30 in which the alkyl polysulfonic acid is an alkyl disulfonic acid.

32. The method of claim 31 in which the alkyl disulfonic acid is selected from the group consisting of methanedisulfonic acid, 1,3-acetonedisulfonic acid, anhydrides thereof, salts thereof, and mixtures thereof.

33. A method for plating tin, the method comprising the steps of:

a) electroplating tin onto a steel strip in an acidic electroplating bath comprising an electrolyte, stannous ion and an anion, and forming a plated strip comprising a plated tin surface comprising a surface layer of tin;

b) performing one or more rinses;

c) exposing the plated tin surface to a solution of about 0.01 vol % to 10 vol % of an organic compound in water, the organic compound selected from the group consisting of acetone, gamma-butyrolactone, and mixtures thereof;

d) heating the plated strip to at least the melting point of tin but to less than the melting point of the steel strip; and e) quenching the plated strip in water.

34. The method of claim 33 in which the acidic electroplating solution comprises an alkyl polysulfonic acid and sulfuric acid, in which the ratio of sulfuric acid to alkyl polysulfonic acid, based on the normality of the acids, is about 3/1 or less.

35. The method of claim 34 in which the alkyl polysulfonic acid is an alkyl disulfonic acid.

36. The method of claim 35 in which the alkyl disulfonic acid is methane disulfonic acid.

37. The method of claim 33 in which the acidic electroplating solution comprises an alkyl polysulfonic acid and methane sulfonic acid, in which the ratio of methane sulfonic acid to alkyl polysulfonic acid, based on the normality of the acids, is about 1/1 or less.

38. The method of claim 37 in which the alkyl polysulfonic acid is an alkyl disulfonic acid.

39. The method of claim 38 in which the alkyl disulfonic acid is methane disulfonic acid.

40. The method of claim 33 in which the anion is methane sulfonate anion.

41. The method of claim 33 in which the anion is an alkyl polysulfonic acid anion.

* * * * *